US008905809B2

(12) United States Patent
Mosher et al.

(10) Patent No.: US 8,905,809 B2
(45) Date of Patent: Dec. 9, 2014

(54) SYSTEM AND METHOD FOR DIRECTING SMOKE IN A MODEL TRAIN SYSTEM

(75) Inventors: Richard James Mosher, Memphis, MI (US); James M. Rohde, Walled Lake, MI (US)

(73) Assignee: Lionel LLC, Concord, NC (US)

( * ) Notice: Subject to any disclaimer, the term of this patent is extended or adjusted under 35 U.S.C. 154(b) by 190 days.

(21) Appl. No.: 13/273,688

(22) Filed: Oct. 14, 2011

(65) Prior Publication Data

US 2012/0094570 A1 Apr. 19, 2012

Related U.S. Application Data

(60) Provisional application No. 61/393,215, filed on Oct. 14, 2010.

(51) Int. Cl.
*A63H 19/14* (2006.01)

(52) U.S. Cl.
CPC ..... *A63H 19/14* (2013.01)
USPC ..... 446/25; 446/467

(58) Field of Classification Search
USPC ..... 446/25, 24, 178, 467
See application file for complete search history.

(56) References Cited

U.S. PATENT DOCUMENTS

| | | | | | |
|---|---|---|---|---|---|
| 360,037 | A * | 3/1887 | Murphy | 446/25 |
| 1,608,142 | A * | 11/1926 | Stephenson | 446/178 |
| 1,737,787 | A * | 12/1929 | Dombrow | 446/25 |
| 2,317,974 | A * | 5/1943 | Bastiansen | 446/25 |
| 2,413,284 | A * | 12/1946 | Bonanno | 446/25 |
| 2,461,664 | A * | 2/1949 | Smith | 446/25 |
| 2,520,916 | A * | 9/1950 | Dasenbrock | 446/25 |
| 2,610,437 | A * | 9/1952 | Smith | 446/25 |
| 2,610,438 | A * | 9/1952 | Smith | 446/25 |
| 2,658,303 | A * | 11/1953 | Pettit | 446/25 |
| 2,673,419 | A * | 3/1954 | Kelch et al. | 446/25 |
| 3,003,279 | A * | 10/1961 | Bonanno | 446/25 |
| 3,074,201 | A * | 1/1963 | Fileger | 446/25 |
| 3,117,393 | A * | 1/1964 | Crosman | 446/25 |
| 3,160,980 | A * | 12/1964 | Seuthe | 446/25 |
| 3,178,850 | A * | 4/1965 | Brown | 446/25 |
| 3,255,551 | A * | 6/1966 | Scheihing | 446/25 |
| RE26,563 | E * | 4/1969 | Seuthe | 446/25 |
| 5,205,771 | A * | 4/1993 | Sims | 446/21 |
| 5,312,281 | A * | 5/1994 | Takahashi et al. | 446/25 |
| 5,512,001 | A * | 4/1996 | Kent et al. | 446/25 |
| 6,280,278 | B1 * | 8/2001 | Wells | 446/25 |
| 6,485,347 | B1 * | 11/2002 | Grubba et al. | 446/25 |
| 6,676,473 | B2 * | 1/2004 | Pierson et al. | 446/25 |
| 7,125,309 | B2 * | 10/2006 | Pierson et al. | 446/25 |

(Continued)

*Primary Examiner* — Gene Kim
*Assistant Examiner* — Joseph B Baldori
(74) *Attorney, Agent, or Firm* — Fitzsimmons IP Law

(57) ABSTRACT

A system and method is provided for directing smoke in a model train. In one embodiment of the present invention, the model train includes a smoke chamber physically connected to a smoke unit. The smoke unit functions to produce smoke, which is then provided to at least one smoke chamber. Each smoke chamber includes at least one exhaust opening and a valve for selectively moving smoke out of the exhaust opening(s). For example, the smoke chamber may include an intake opening, at least two exhaust openings, a piston core and a piston driven by a drive rod. By moving the drive rod, the piston can be moved through the piston core, resulting in the movement of smoke out of the exhaust openings. By positioning the exhaust openings near the wheels of the model train, the smoke system can be used to simulate steam escaping from valves or cylinders.

18 Claims, 3 Drawing Sheets

(56) References Cited

U.S. PATENT DOCUMENTS

| | | | | |
|---|---|---|---|---|
| 7,297,045 | B2 * | 11/2007 | Pierson et al. | 446/467 |
| 7,749,040 | B2 * | 7/2010 | Grubba | 446/25 |
| 8,025,545 | B2 * | 9/2011 | Zahornacky et al. | 446/25 |
| 8,393,931 | B2 * | 3/2013 | Koball et al. | 446/25 |
| 2004/0005836 | A1 * | 1/2004 | Pierson et al. | 446/24 |
| 2004/0198135 | A1 * | 10/2004 | Pierson et al. | 446/25 |
| 2010/0015880 | A1 * | 1/2010 | Grubba | 446/25 |
| 2010/0062675 | A1 * | 3/2010 | Zahornacky et al. | 446/25 |
| 2010/0323578 | A1 * | 12/2010 | Koball et al. | 446/25 |

* cited by examiner

SYSTEM AND METHOD FOR DIRECTING SMOKE IN A MODEL TRAIN SYSTEM

CROSS-REFERENCE TO RELATED APPLICATION

This application claims priority pursuant to 35 U.S.C. §119 (e) to U.S. provisional patent application Ser. No. 61/393,215 filed Oct. 14, 2010, the subject matter of which is incorporated by reference herein in its entirety.

BACKGROUND OF THE INVENTION

1. Field of the Invention

The present invention relates to model devices, or more particularly, to a system and method for directing smoke in a model train system, including at least one model train.

2. Description of Related Art

It is known in the art for model vehicles, such as model trains, to include smoke-generating devices. Some smoke generating devices generate smoke that drifts out of a smokestack to simulate the production of smoke from the burning of fuel, such as coal or wood. Other model trains may use a smoke generator to simulate steam escaping from valves or cylinders. More sophisticated model trains may even use a blower fan coupled with a smoke-generating device in order to force smoke out of an opening.

Most smoke generation systems, however, do not produce smoke in a realistic fashion, and are unable to direct smoke to particular locations in order to simulate particular operating conditions. For example, when an actual steam locomotive first starts up, valves called cylinder cocks are opened to allow accumulated water to drain that might otherwise damage pistons. The open cylinder cocks allow large quantities of steam to escape from the cylinders of the locomotive until the cylinders are clear and the engineer closes the cylinder cocks.

Thus, to provide more realism in a model train system, it would be desirable to direct smoke from a smoke generator to the vicinity of the locomotive wheels to at least simulate the opening of cylinder cocks, and to do so in a manner that realistically simulates the production of smoke (or steam) on an actual train. It may also be advantageous to synchronize the production of smoke (or steam) to movement of the model train (or its motor) and/or at least one sound (e.g., a steam whistle, a "chuffing" or "hissing" sound, etc.).

SUMMARY OF THE INVENTION

The present invention provides a system and method for directing smoke in a model train system. Preferred embodiments of the present invention operate in accordance with a model train that includes a smoke unit and a smoke chamber physically connected to the smoke unit. The smoke unit functions to produce smoke, which is then provided to at least one smoke chamber. Each smoke chamber includes at least one exhaust opening and a valve for selectively moving smoke out of the exhaust opening(s). By positioning the exhaust openings near the wheels of the model train, the smoke system can be used to simulate steam escaping from valves or cylinders.

In one embodiment of the present invention, the smoke unit further includes a smoke generator for generating smoke and a fan for moving the smoke to the smoke chamber. In accordance with this embodiment, the smoke chamber includes an intake opening, at least two exhaust openings, a piston core and a piston driven by a drive rod. By moving the drive rod, the piston can be moved through the piston core, resulting in the movement of smoke out of the exhaust openings. For example, when the piston is located over the second exhaust opening, smoke is moved out of the first exhaust opening. Similarly, when the piston is located over the first exhaust opening, smoke is moved out of the second exhaust opening.

In should also be appreciated that the present invention is not limited to any particular method of moving the piston through the piston core. For example, a wheel can be connected to the drive rod, and rotated about a central axis to move the piston through the piston core. The wheel can be rotated using either an existing train component (e.g., a wheel axel, a drive motor, etc.) or an added component (e.g., a motor, etc.), which is used to control at least the exhaustion of smoke from the smoke chamber.

By way of another example, an electromagnetic coil and a return spring can be used to move the piston through the piston core. By applying electricity to the electromagnetic coil, an electric field can be generated and used to move (i.e., push or pull) the piston through the piston core in a first direction. When the electricity is removed from the electromagnetic coil, a return spring (e.g., a torsion or compression spring) can be used to move the piston through the piston core in a reverse direction. A processor in the model train can then be used to control the application of power to the electromagnetic coil. The manner in which power is applied to the coil can be determined by the processor itself and/or by signals provided by a user via a remote control.

By way of another example, a first electromagnetic coil can be positioned near a first end of the smoke chamber, and a second electromagnetic coil can be positioned near a second end of the smoke chamber. By applying electricity to the coils, electric (or magnetic) fields can be generated and used to move (e.g., push or pull) the piston through the piston core. The piston can either be made out of a magnetic material or include a plurality of magnets. A processor in the model train can be used to control the application of power to the electromagnetic coils. As in the previous embodiment, the manner in which power is applied can either be determined by the processor itself or by a user via a remote control.

By way of another example, a lever can be connected to the drive rod and moved about an axis to move the piston through the piston core. The lever can be rotated using either an existing train component or an added component (e.g., a motor, etc.), which is used to control at least the exhaustion of smoke from the smoke chamber.

A more complete understanding of a system and method for directing smoke in a model train system will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

Figure 1:
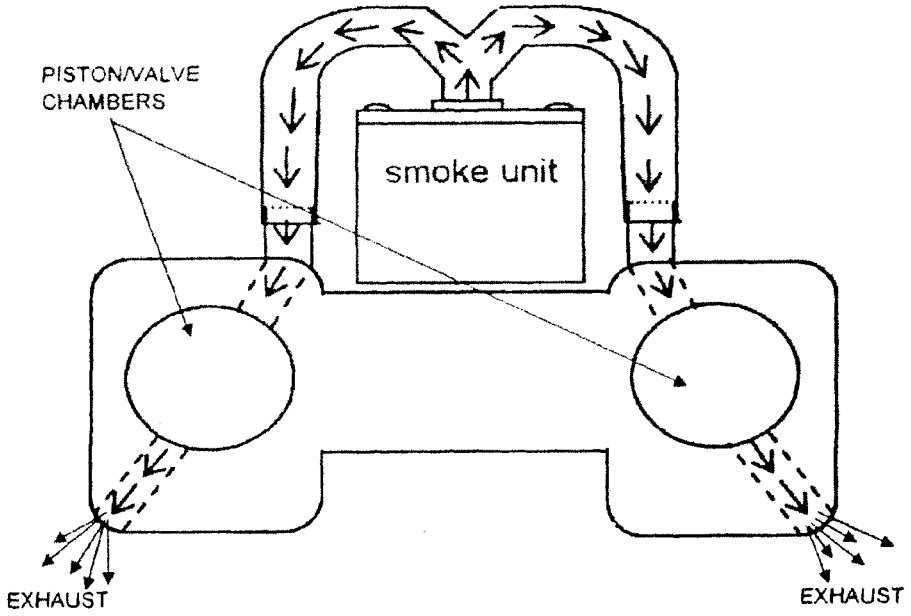
FIG. 1 illustrates a smoke directing system in accordance with a preferred embodiment of the present invention, comprising a smoke unit and a smoke chamber physically connected to the smoke unit.

The present invention provides a system and method for directing smoke in a model train system. In the detailed description that follows, like element numerals are used to describe like elements illustrated in one or more figures. As shown in FIG. 1, preferred embodiments of the present invention operate in accordance with a model train (e.g., a steam engine, diesel engine, etc.) that includes a smoke unit and a smoke chamber physically connected to the smoke unit. The smoke unit functions to produce smoke, which is then provided (e.g., via a plurality of tubes or paths) to at least one smoke chamber. Each smoke chamber includes at least one exhaust opening and a valve (e.g., a piston, etc.) for selectively moving smoke out of the exhaust opening(s). By positioning the exhaust openings near the wheels of the model train, the smoke system can be used to simulate steam escaping from valves or cylinders. Such a system can be used alone, or in conjunction with the smoke redirection system disclosed in Ser. No. 12/488,373, filed Jun. 19, 2009, which is incorporated herein by reference, in its entirety.

It should be appreciated that the present invention is not limited to the production and distribution of smoke. The production and distribution of other visual substances (like steam) (e.g., in a steam locomotive, a diesel locomotive, etc.) are within the spirit and scope of the present invention. It should also be appreciated that the present invention is not limited to exhaust openings near the wheels of the model train. Exhausting smoke from other locations (e.g., a smokestack, etc.) is within the spirit and scope of the present invention. This may be achieve using a plurality of tubes (or paths) to direct smoke to a plurality of exhaust openings, and (optionally) individual valves to release smoke from individual exhaust openings. For example, if the exhaustion of smoke needs to be controlled (e.g., to simulated the opening/closing of cylinder cocks, the starting/stopping of a dynamo, etc.), at least one valve should be positioned in the corresponding smoke chamber, wherein the valve is controlled electrically and/or mechanically. If, however, the exhaustion of smoke does not need to be controlled (e.g., to simulate a smokestack, a steam leak, etc.), then a valve in the corresponding smoke chamber many not be necessary. In such a situation, the activation of the smoke unit would (by itself) result in the exhaustion of smoke from the corresponding smoke chamber. It should further be appreciated that the smoke unit (or components included therein) and/or the valves may be automatically controlled by the model train (or a processor included therein) (e.g., to simulate a start-up condition, to simulate movement of a train, etc.) and/or by a user via a remote control. For example, a user may choose to operate the model train so that smoke is being exhausted from around the train's wheels and from the train's smokestack when the train is in operation.

Figure 2:
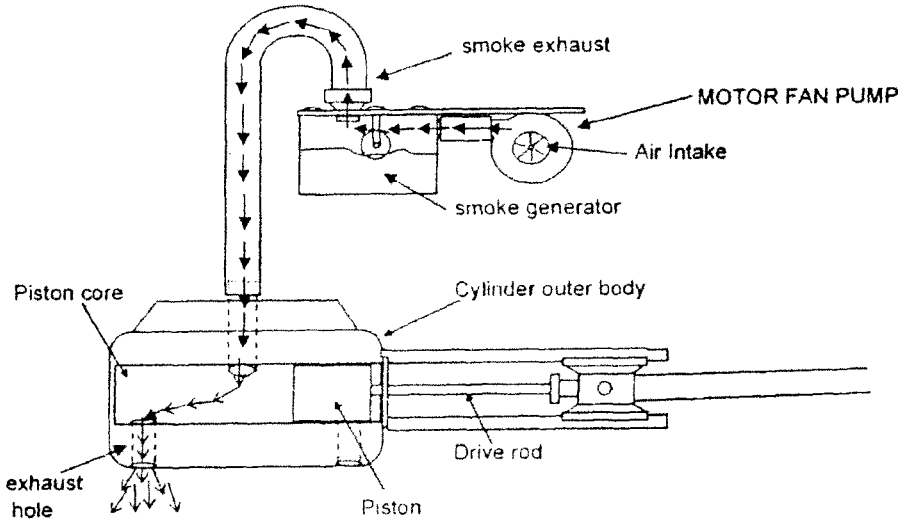
FIGS. 2 and 3 illustrate a smoke directing system in accordance with one embodiment of the present invention, wherein the smoke chamber includes a piston that is moved through a piston core to exhaust smoke from a plurality of exhaust openings.
Figure 3:
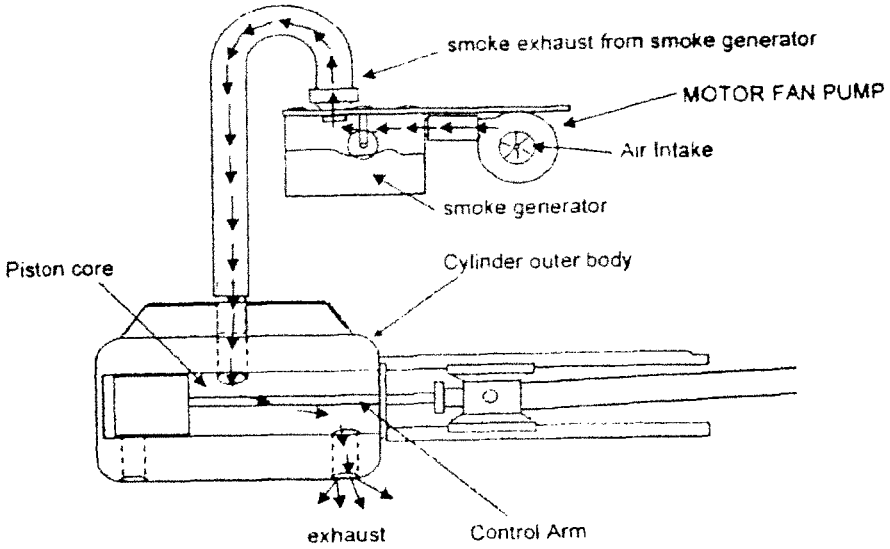

In one embodiment of the present invention, as shown in FIG. 2, the smoke unit further includes a smoke generator for generating smoke and a fan for moving the smoke to the smoke chamber. In accordance with this embodiment, the smoke chamber includes an intake opening, at least two exhaust openings, a piston core and a piston driven by a drive rod. By moving the drive rod (e.g., substantially horizontally), the piston can be moved through the piston core, resulting in the movement of smoke out of the exhaust openings. For example, when the piston is located over the second exhaust opening (see FIG. 2), smoke is moved out of the first exhaust opening. Similarly, when the piston is located over the first exhaust opening (see FIG. 3), smoke is moved out of the second exhaust opening. It should be appreciated that the present invention is not limited to the smoke system shown in FIGS. 2 and 3. Thus, for example, a smoke system that includes different components (e.g., a bellow instead of a fan, etc.), additional components (e.g., a bellow that functions together with the fan, etc.), or components in different locations (e.g., a fan located in the smoke chamber, etc.) is within the spirit and scope of the present invention. It should also be appreciated that smoke can be prevented from moving out of either exhaust opening by using a second valve in conjunction with the intake opening, or positioning the piston over the intake opening, thereby preventing the smoke from entering the piston core. In should also be appreciated that the present invention is not limited to any particular method of moving the piston through the piston core.

Figure 4:
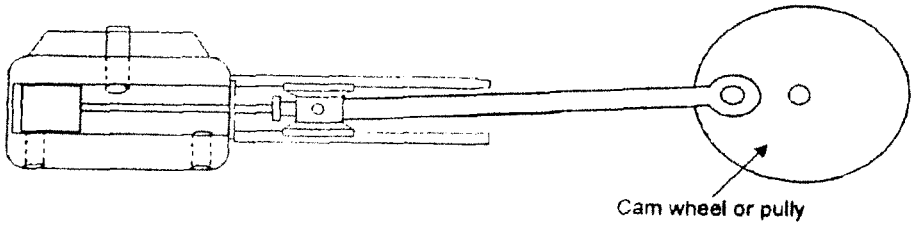
FIG. 4 illustrates a first exemplary system for moving the piston through the piston core.

For example, as shown in FIG. 4, a wheel can be connected to the drive rod, and rotated about a central axis to move the piston through the piston core. It should be appreciated that the wheel can be rotated using either an existing train component (e.g., a wheel axel, a drive motor, etc.) or an added component (e.g., a motor, etc.), which is used to control at least the exhaustion of smoke from the smoke chamber.

Figure 5:
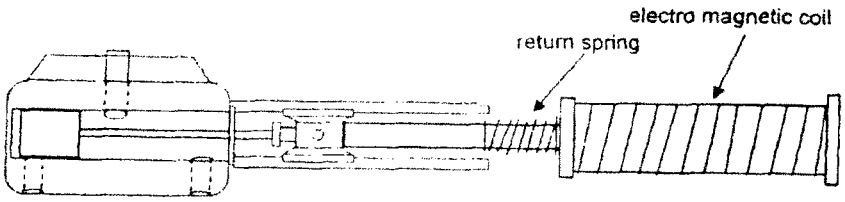
FIG. 5 illustrates a second exemplary system for moving the piston through the piston core.

By way of another example, as shown in FIG. 5, an electromagnetic coil and a return spring can be used to move the piston through the piston core. By applying electricity to the electromagnetic coil, an electric field can be generated and used to move (i.e., push or pull) the piston through the piston core in a first direction. When the electricity is removed from the electromagnetic coil, a return spring (e.g., a torsion or compression spring) can be used to move the piston through the piston core in a reverse direction. It should be appreciated that a processor in the model train can be used to control the application of power to the electromagnetic coil. The manner (e.g., start, duration, frequency, etc.) in which power is applied to the coil can be determined by the processor itself (e.g., based on signals received from other devices, signals received from sensors, at least one program stored in a memory in communication with the processor, etc.) and/or by signals provided by a user via a remote control.

Figure 6:
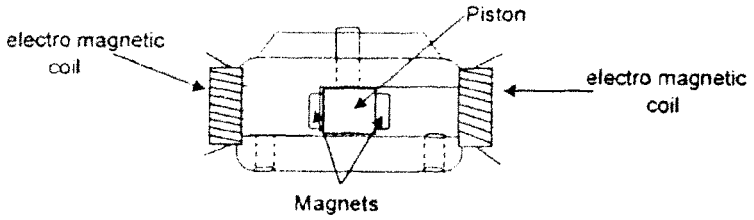
FIG. 6 illustrates a third exemplary system for moving the piston through the piston core.

By way of another example, as shown in FIG. 6, a first electromagnetic coil can be positioned near a first end of the smoke chamber, and a second electromagnetic coil can be positioned near a second end of the smoke chamber. By applying electricity to the coils, electric (or magnetic) fields can be generated and used to move (e.g., push or pull) the piston through the piston core. It should be appreciated that in this embodiment of the present invention, the piston can either be made out of a magnetic material or include a plurality of magnets (as shown in FIG. 6). It should also be appreciated that in this embodiment of the present invention, a drive rod may not be necessary since the electromagnetic coils are being used directly to move the piston through the piston core. It should further be appreciated that a processor in the model train can be used to control the application of power to the electromagnetic coils. As in the previous embodiment, the manner in which power is applied can either be determined by the processor itself or by a user via a remote control.

Figure 7:
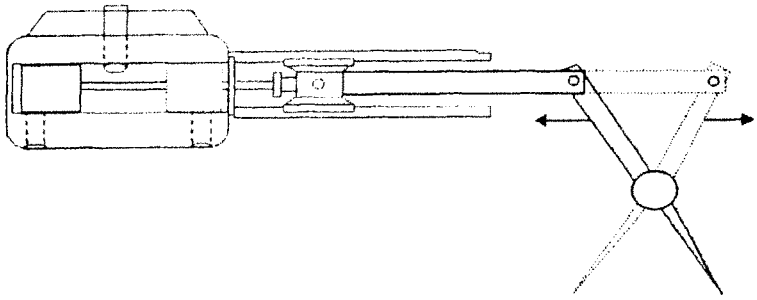
FIG. 7 illustrates a fourth exemplary system for moving the piston through the piston core.

By way of another example, as shown in FIG. 7, a lever can be connected to the drive rod and moved about an axis to move (or toggle) the piston through the piston core. It should be appreciated that the lever can be rotated using either an existing train component or an added component (e.g., a motor, etc.), which is used to control at least the exhaustion of smoke from the smoke chamber.

The foregoing description of a system and method for directing smoke in a model train has been presented for the purposes of illustration and description. It is not intended to be exhaustive or to limit the invention to the precise forms disclosed, and many modifications and variations are possible in light of the above teachings. For example, the foregoing system may be used in conjunction with a sound system configured to use information (e.g., signals from sensors, signals used to move the drive rod, signals used to move the piston through the piston core, etc.) to synchronize sound (e.g., steam whistle, "chuffing" sound, "hissing" sound, etc.) to an exhaustion of smoke. For example, a signal from a processor in the train that is used to apply power to an electromagnetic device, resulting in the exhaustion of smoke from a first exhaust opening, can also be used to activate a particular sound associated with that exhaustion of smoke.

Having thus described several embodiments of a system and method for directing smoke in a model train system, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A model train comprising:

a smoke unit configured to produce a quantity of smoke; and a smoke chamber comprising at least one intake opening physically connected to the smoke unit, at least two exhaust openings, a piston, and a drive rod; and a fan configured to move at least a portion of the quantity of smoke to the smoke chamber;

wherein the at least one intake opening is configured to receive the at least a portion of the quantity of smoke from the smoke unit, a first end of the drive rod is physically connected to the piston, and the drive rod is configured to move the piston (i) away from a first one of the at least two exhaust openings and over a second one of the at least two exhaust openings to enable a first portion of the quantity of smoke to exit the first one of the at least two exhaust openings and (ii) away from the second one of the at least two exhaust openings and over the first one of the at least two exhaust openings to enable a second portion of the quantity of smoke to exit the second one of the at least two exhaust openings.

2. The model train of claim 1, wherein the smoke unit further comprises a smoke generator for generating the quantity of smoke.

3. The model train of claim 1, wherein the model train further comprises a motor in communication with a second end of the drive rod, wherein the motor is configured to move at least a portion of the drive rod, and thereby the piston, through the smoke chamber.

4. The model train of claim 3, wherein the motor is further configured to rotate at least one wheel of the model train.

5. The model train of claim 3, wherein the motor is further configured to rotate at least a cam connected to the second end of the drive rod, wherein the rotation of the cam results in the movement of the at least a portion of the drive rod, and thereby the piston, through the smoke chamber.

6. The model train of claim 3, wherein the motor is further configured to toggle a lever connected to the second end of the drive rod, wherein the toggling of the lever results in the movement of the at least a portion of the drive rod, and thereby the piston, through the smoke chamber.

7. The model train of claim 1, wherein the model train further comprises an electromagnetic coil around a second end of the drive rod, wherein power is applied to the electromagnetic coil to move at least a portion of the drive rod, and thereby the piston, through the smoke chamber in a first direction.

8. The model train of claim 7, wherein the model train further comprises a return spring physically connected to the second end of the drive rod, wherein power is removed from the electromagnetic coil to move at least a portion of the drive rod, and thereby the piston, through the smoke chamber in a second direction, the second direction being opposite the first direction.

9. A method for directing smoke in a model train, comprising:

producing by a smoke generator a quantity of smoke;

moving by at least one fan at least a portion of the quantity of smoke through at least one tube and into a smoke chamber;

manipulating a piston (i) away from a first one of at least two exhaust openings in the smoke chamber and over a second one of the at least two exhaust openings to allow a first portion of the smoke to be exhausted from a first one of the at least two exhaust openings, and (ii) away from the second one of the at least two exhaust openings in the smoke chamber and over the first one of the at least two exhaust openings to enable a second portion of the quantity of smoke to exit from the second one of the at least two exhaust openings, thereby simulating an exhaustion of smoke from the model train.

10. The method of claim 9, wherein the step of manipulating a piston away from a first one of the at least two exhaust openings in the smoke chamber further comprises manipulating a drive rod in order to exhaust the first portion of the smoke from the first one of the at least two exhaust openings, wherein a first end of the drive rod is physically connected to the piston.

11. The method of claim 10, wherein the step of manipulating the drive rod further comprises using a motor to manipulate the drive rod, wherein the motor is in communication with a second end of the drive rod.

12. The method of claim 11, wherein the motor is further used to rotate at least one wheel of the model train.

13. The method of claim 11, wherein the step of using the motor to manipulate the drive rod further comprises using the motor to rotate at least a cam connected to the second end of the drive rod.

14. The method of claim 11, wherein the step of using the motor to manipulate the drive rode further comprises using the motor to toggle a lever connected to the second end of the drive rod.

15. The model train of claim 10, wherein the step of manipulating the drive rod further comprises using an electromagnetic coil and a return spring to manipulate the drive rod.

16. A model train comprising:

a first unit configured to produce a quantity of visual substance selected from smoke and steam;

a second unit physically connected to the first unit, and comprising at least a first and a second exhaust opening, at least one piston, and at least one drive rod; and a fan configured to move at least a portion of the quantity of visual substance to the second unit;

wherein the second unit is configured to receive the at least a portion of the quantity of visual substance from the first unit, a first end of the at least one drive rod is physically connected to the at least one piston, and the at least one drive rod is configured to move the at least one piston (i) away from the first exhaust opening and over the second exhaust opening to enable a first portion of the at least a portion of the quantity of visual substance to be exhausted from the first exhaust opening and (ii) over the second exhaust opening and over the first exhaust opening to enable a second portion of the at least a portion of the quantity of visual substance from the second exhaust opening.

17. The model train of claim 16, wherein the model train further comprises a motor in communication with a second end of the drive rod, wherein the motor is configured to move at least a portion of the at least one drive rod, and thereby the at least one piston, through the second unit, and to rotate at least one wheel of the model train.

18. The model train of claim 17, wherein the motor is further configured to one rotate at least one cam connected to the second end of the drive rod and toggle at least one lever connected to the second end of the drive rod, wherein the rotation of the at least one cam results in the movement of the at least a portion of the at least one drive rod, and thereby the at least one piston, through the second unit, and the toggling of the at least one lever results in the movement of the at least a portion of the at least one drive rod, and thereby the at least one piston, through the second unit.

* * * * *